US006902049B2

(12) United States Patent
King

(10) Patent No.: US 6,902,049 B2
(45) Date of Patent: Jun. 7, 2005

(54) APPARATUS FOR VALIDATING CURRENCY ITEMS, AND METHOD OF CONFIGURING SUCH APPARATUS

(75) Inventor: Katharine Louise King, Hampshire (GB)

(73) Assignee: Mars, Incorporated, McLean, VA (US)

( * ) Notice: Subject to any disclaimer, the term of this patent is extended or adjusted under 35 U.S.C. 154(b) by 151 days.

(21) Appl. No.: 10/328,306

(22) Filed: Dec. 23, 2002

(65) Prior Publication Data

US 2003/0121754 A1 Jul. 3, 2003

(30) Foreign Application Priority Data

Dec. 28, 2001 (EP) ..... 01310946

(51) Int. Cl.[7] ..... G07D 7/00
(52) U.S. Cl. ..... 194/302
(58) Field of Search ..... 194/215, 216, 194/217, 302; 73/163

(56) References Cited

FOREIGN PATENT DOCUMENTS

| | | | | |
|---|---|---|---|---|
| EP | 0 072 189 A2 | | 2/1983 | ..... G07F/3/02 |
| EP | 0 480 736 A2 | | 4/1992 | ..... G07F/3/02 |
| EP | 1 004 991 A2 | | 5/2000 | ..... G07D/5/00 |
| GB | 2 059 129 B | | 4/1981 | ..... G07C/3/14 |
| GB | 2.164.188 A | * | 3/1986 | ..... G07D/5/08 |
| GB | 2 251 111 A | | 6/1992 | ..... G07D/5/00 |
| WO | WO 80/01963 | | 9/1980 | ..... G07C/3/14 |
| WO | WO 99/49423 A1 | * | 9/1999 | ..... G07F/3/02 |
| WO | WO 99/49423 | | 9/1999 | ..... G07F/3/02 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A currency validator processes sensor measurements by transforming them using a linear function so that, following calibration, the measurements of an article resemble standard measurements. The acceptance criteria are gradually modified by a self-tuning operation. The validator can be re-configured to permit it to recognise a new class of articles by (a) deriving a standard set of acceptance criteria for the new class, and (b) altering the acceptance criteria to an extent determined by the extent to which acceptance criteria for a further class differ from standard acceptance criteria for that class, due to self-tuning.

12 Claims, 7 Drawing Sheets

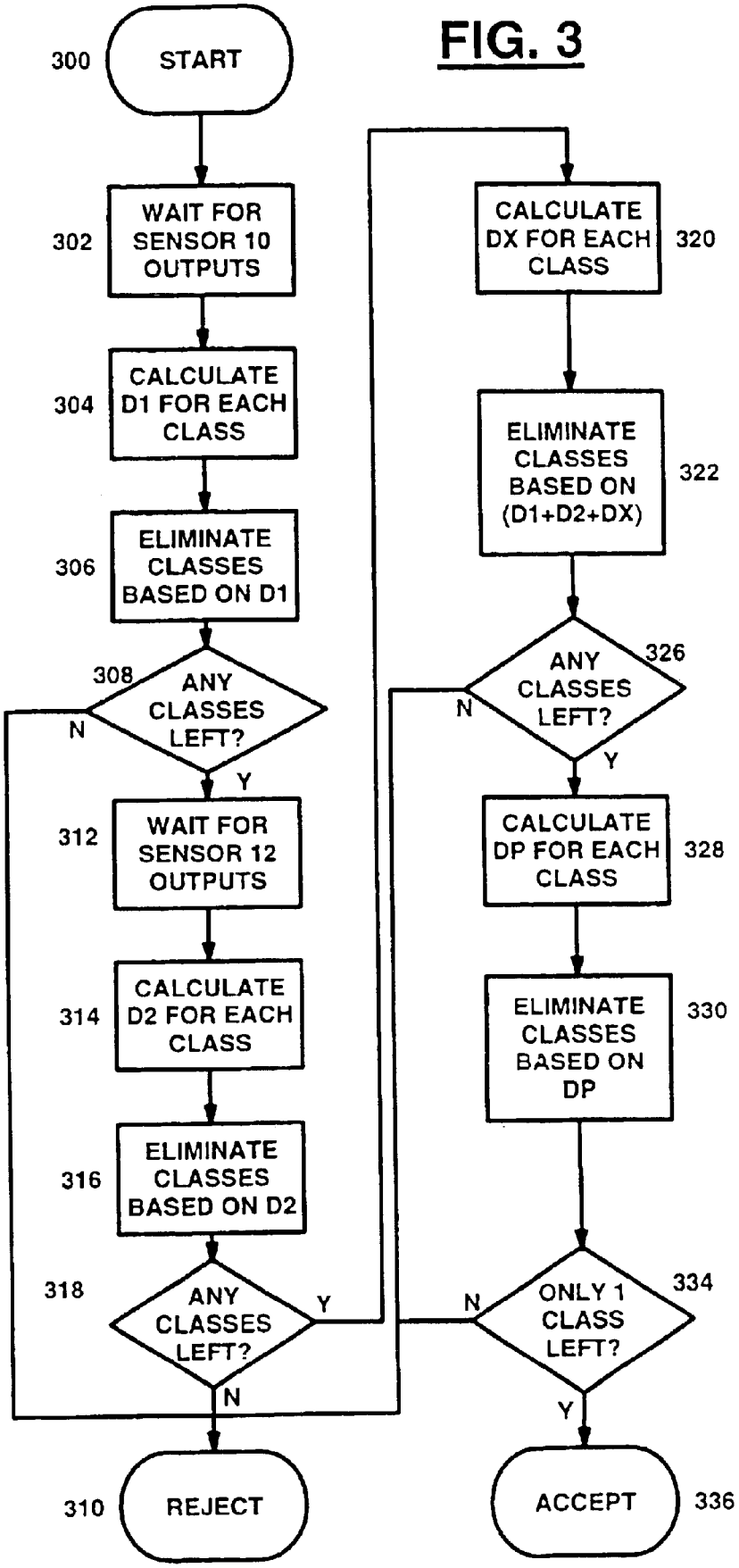
FIG. 3
300
START
302
WAIT FOR SENSOR 10 OUTPUTS
304
CALCULATE D1 FOR EACH CLASS
306
ELIMINATE CLASSES BASED ON D1
308
ANY CLASSES LEFT?
N
Y
312
WAIT FOR SENSOR 12 OUTPUTS
314
CALCULATE D2 FOR EACH CLASS
316
ELIMINATE CLASSES BASED ON D2
318
ANY CLASSES LEFT?
Y
N
310
REJECT
320
CALCULATE DX FOR EACH CLASS
322
ELIMINATE CLASSES BASED ON (D1+D2+DX)
326
ANY CLASSES LEFT?
N
Y
328
CALCULATE DP FOR EACH CLASS
330
ELIMINATE CLASSES BASED ON DP
334
ONLY 1 CLASS LEFT?
N
Y
336
ACCEPT

APPARATUS FOR VALIDATING CURRENCY ITEMS, AND METHOD OF CONFIGURING SUCH APPARATUS

BACKGROUND OF THE INVENTION

This invention relates to apparatus for validating items of value, particularly currency articles, and to methods of configuring such apparatus. The invention will be described in the context of coin validators, but is also applicable to banknote validators and validators for other items of value.

It is well known to take measurements of coins and apply acceptability tests to determine whether the coin is valid and the denomination of the coin. The acceptability tests are normally based on stored acceptability data. One common technique (see, e.g. GB-A-1 452 740) involves storing "windows", i.e. upper and lower limits for each test. If each of the measurements of a coin falls within a respective set of upper and lower limits, then the coin is deemed to be acceptable. The acceptability data could instead represent a predetermined value such as a mean, the measurements then being tested to determine whether they lie within predetermined ranges of that value. Alternatively, the acceptance data could be a look-up table which is addressed by the measurements, and the output of which indicates whether the measurements are suitable for a particular denomination (see, e.g. EP-A-0 480 736, and U.S. Pat. No. 4,951,799). Instead of having separate acceptance criteria for each test, the measurements may be combined and the result compared with stored acceptance data (cf. GB-A-2 238 152 and GB-A-2 254 949). Alternatively, some of these techniques could be combined, e.g. by using the acceptability data as coefficients (derived, e.g. using a neural network technique) for combining the measurements, and possibly for performing a test on the result.

The acceptability data can be derived in a number of different ways. For example, each validator can be calibrated by feeding many items into the validator and acquiring test measurements of the items. The acceptance data is then derived from the test measurements, and takes account of the individual sensor response characteristics of the validator; accordingly the acceptability data will vary from validator to validator. Another technique may involve deriving the acceptability data using a standard machine (which may in practice be a nominal machine, the data being derived by statistical analysis of test measurements performed in a group of machines of similar construction, or at least having sensor arrangements of similar construction.). This acceptance data can then be transferred to production validators. If individual differences within the validators require that they be individually calibrated, then the acceptance data could be modified, for example using the techniques described in GB-A-2 199 978.

It is also known for validators to have an automatic re-calibration function, sometimes known as "self-tuning", whereby the acceptance data is regularly updated on the basis of measurements performed during testing (see for example EP-A-0 155 126, GB-A-2 059 129, and U.S. Pat. No. 4,951,799).

It is sometimes desirable to re-configure an existing validator in the field (c.f. GB-A-2 199 978 and WO-A-96/07992). For example, if the validator is arranged to validate a certain range of denominations it may be desired to add a different denomination to that range, or to substitute one of those denominations for a different one. However, it is desirable to avoid the need to perform a very large number of tests in order to calibrate the validator for the new denomination.

SUMMARY OF THE INVENTION

It would be desirable to provide an improved technique for re-configuring a validator. It would also be desirable to produce validators which can be configured or re-configured more easily.

Aspects of the present invention are set out in the accompanying claims.

According to another aspect of the invention, a currency acceptor, or validator, has means for processing at least one measurement of an article using calibration factors derived in a calibration operation, the calibration factors being chosen so as to transform the measurements of a predetermined group of calibration classes into values which are approximately the same as a set of standard values. These standard values can be derived from a standard (possibly nominal) validator of similar construction. Preferably, the calibration factors represent a linear function which is applied to the sensor readings. Accordingly, for each measurement type, there is derived a gain factor G and an offset factor O which derives a value M from a measurement A using the formula:

$$M=A\cdot G+O$$

This technique allows each validator to be configured such that it produces predictable sensor outputs which match a standard. Accordingly, it is much easier to provide appropriate acceptance criteria, because these can be common to multiple validators.

In order to enhance reliability of the mechanisms, each acceptor is preferably capable of "self-tuning" operations which modify the acceptance criteria on a class-by-class basis, in dependence upon the measurements of classified articles. Following this procedure, the acceptance criteria will no longer be common to different validators.

According to a further aspect of the invention, a validator is capable of a self-tuning operation in which acceptance criteria for respective denominations, or classes, are modified in accordance with measurements made of articles which have been tested and found to belong to those classes. In order to re-configure the apparatus to permit it to recognise articles of a different class, acceptance criteria for the new denomination are derived by taking into account the extent to which the acceptance criteria for at least one other class (and preferably at least two other classes) have been modified by the self-tuning operation. In this way, it is possible to derive a modification factor for the new class, and to apply this modification factor to a nominal set of acceptance criteria for that class to permit recognition of the class.

In the preferred embodiment, each validator has an initial state in which the acceptance criteria for respective denominations are common to all the validators. In accordance with the previously described aspect of the invention, any individual calibration of the validators is achieved by adjusting the measurements generated by the sensors so as to match the outputs of a standard (nominal) validator. Thus, there can be centrally stored standard acceptance criteria for use in all production validators.

The production validators are put into use, and over time the acceptance criteria are modified as a result of the self-tuning operation.

If a validator is to be re-configured to permit it to recognise a new denomination, then a standard set of acceptance criteria for the new denomination is provided for the validator. However, to improve reliability, this standard set is modified by taking into account how other acceptance criteria have shifted due to self-tuning from their initial state. Thus, the acceptance criteria for the new denomination have the benefit of being adjusted to take into account the added reliability resulting from self-tuning operations performed on other denominations.

The re-configuration operation may be accomplished by deriving, for each measured parameter, a modification factor which corresponds to the alteration of the standard acceptance criteria (for the same parameter) for another denomination for which the measured parameter is of similar magnitude. Alternatively, or additionally, the modification factor may be based on interpolation of self-tuning alterations applied to acceptance criteria for two or more other classes.

In an alternative embodiment, the initial acceptance criteria are adapted to the individual mechanism in accordance with a calibration procedure. When a new denomination is to be recognised, a nominal set of acceptance criteria for the denomination is created, and adjusted in accordance with the calibration of the validator. This could, for example, be done using the techniques described in GB-A-2 199 978. The acceptance criteria are then modified in accordance with self-tuning adjustments which have been made, since the calibration operation, on acceptance criteria relating to other classes.

The re-configuration operation can be carried out using a portable terminal coupled to the validator so that it does not have to be removed from its site. Alternatively, the necessary software for performing the re-configuration may be contained within the validator itself, and the operation performed once the validator has received initial acceptance criteria for the new denomination.

The initial acceptance criteria for the new class may be developed at a central location, for example at the factory of the validator manufacturer. The data could then be transferred to individual validators using either a portable terminal or communication lines, such as telephone lines. If the initial acceptance criteria needs to be modified in accordance with calibration factors for each validator, these factors may be stored at the central location so that the initial acceptance criteria for the individual validators can be carried out at that location. Alternatively, the calibration factors may be stored within the validators, and the adjustment of the acceptance windows may be achieved by transmitting the calibration factors to a central location or to a terminal, or may be carried out by the validator itself.

The determination of the extent to which the acceptance criteria for other classes have been modified by self-tuning can be carried out by reading the current acceptance criteria and comparing this with the original criteria. Each validator may be arranged to store an indication of its initial acceptance criteria, so as to permit determination of the amount by which the acceptance criteria have shifted. Alternatively, if the initial acceptance criteria are developed at a central location, the re-configuration operation may involve retrieving acceptability data from this location.

BRIEF DESCRIPTION OF THE DRAWINGS

An embodiment of the present invention will now be described by way of example with reference to the accompanying drawings, in which:

FIG. 3 is a flow chart showing an acceptance-determining operation of the validator;

DETAILED DESCRIPTION

Figure 1:
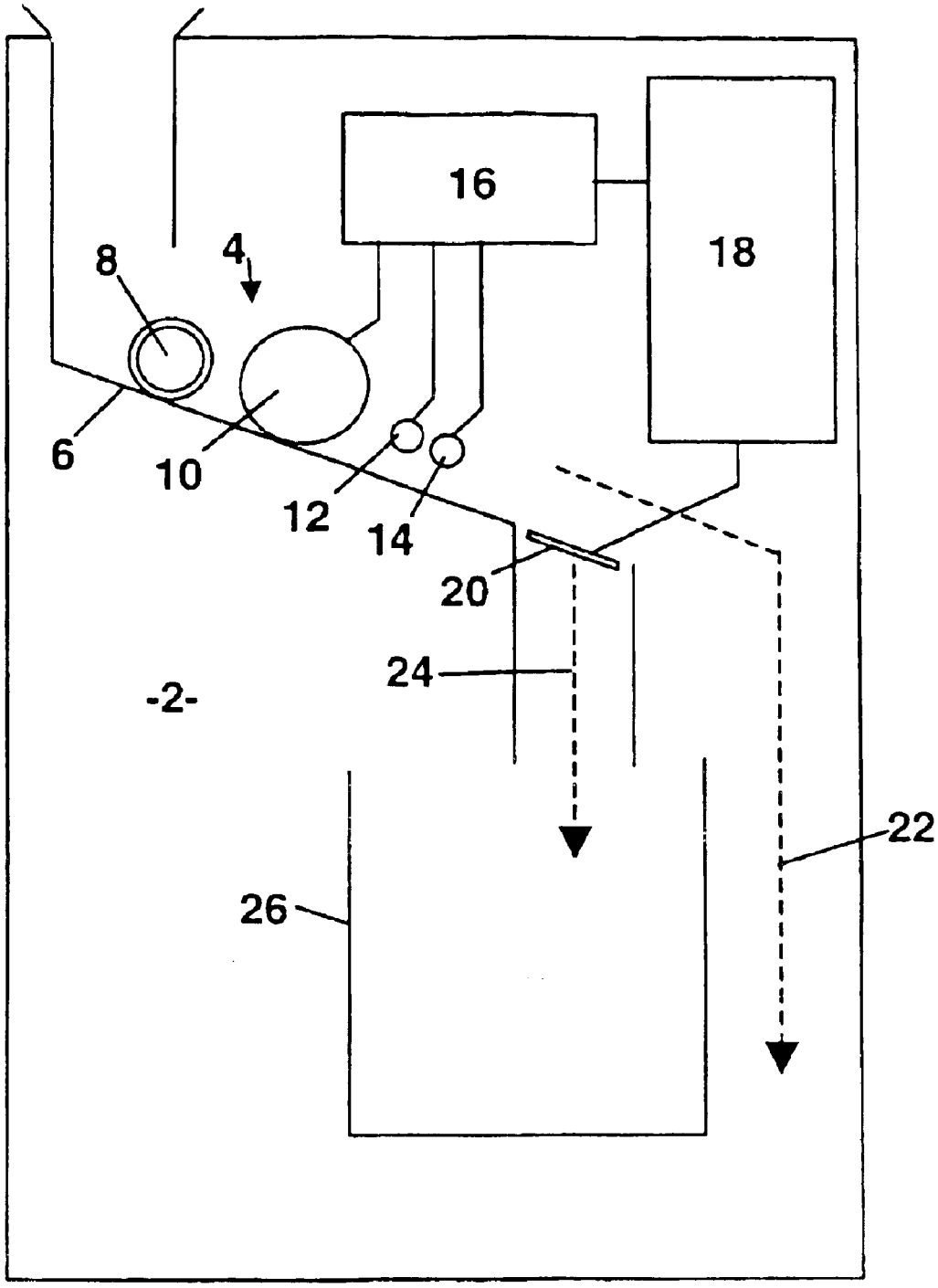
FIG. 1 is a schematic diagram of a coin validator in accordance with the invention.

Referring to FIG. 1, a coin validator 2 includes a test section 4 which incorporates a ramp 6 down which coins, such as that shown at 8, are arranged to roll. As the coin moves down the ramp 6, it passes in succession three sensors, 10, 12 and 14. The outputs of the sensors are delivered to an interface circuit 16 to produce digital values which are read by a processor 18. Processor 18 determines whether the coin is valid, and if so the denomination of the coin. In response to this determination, an accept/reject gate 20 is either operated to allow the coin to be accepted, or left in its initial state so that the coin moves to a reject path 22. If accepted, the coin travels by an accept path 24 to a coin storage region 26. Various routing gates may be provided in the storage region 26 to allow different denominations of coins to be stored separately.

In the illustrated embodiment, each of the sensors comprises a pair of electromagnetic coils located one on each side of the coin path so that the coin travels therebetween. Each coil is driven by a self-oscillating circuit. As the coin passes the coil, both the frequency and the amplitude of the oscillator change. The physical structures and the frequency of operation of the sensors 10, 12 and 14 are so arranged that the sensor outputs are predominantly indicative of respective different properties of the coin (although the sensor outputs are to some extent influenced by other coin properties).

In the illustrated embodiment, the sensor 10 is operated at 60 KHz. The shift in the frequency of the sensor as the coin moves past is indicative of coin diameter, and the shift in amplitude is indicative of the material around the outer part of the coin (which may differ from the material at the inner part, or core, if the coin is a bicolour coin).

The sensor 12 is operated at 400 KHz. The shift in frequency as the coin moves past the sensor is indicative of coin thickness and the shift in amplitude is indicative of the material of the outer skin of the central core of the coin.

The sensor 14 is operated at 20 KHz. The shifts in the frequency and amplitude of the sensor output as the coin passes are indicative of the material down to a significant depth within the core of the coin.

Figure 2:
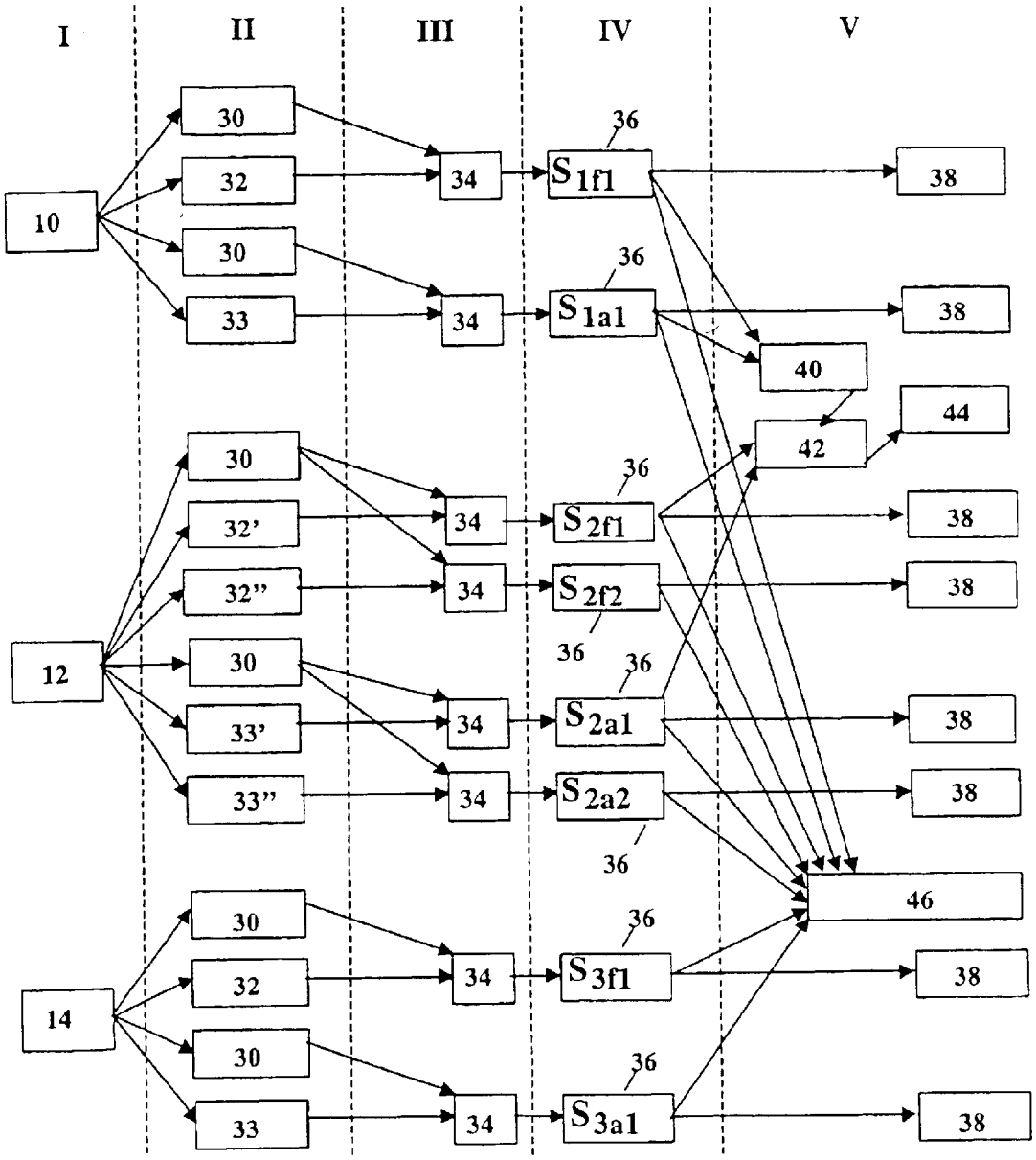
FIG. 2 is a diagram to illustrate the way in which sensor measurements are derived and processed.

FIG. 2 schematically illustrates the processing of the outputs of the sensors. The sensors 10, 12 and 14 are shown in section I of FIG. 2. The outputs are delivered to the interface circuit 16 which performs some preliminary processing of the outputs to derive digital values which are handled by the processor 18 as shown in sections II, III, IV and V of FIG. 2.

Within section II, the processor 18 stores the idle values of the frequency and the amplitude of each of the sensors, i.e. the values adopted by the sensors when there is no coin present. The procedure is indicated at blocks 30. The circuit also records the peak of the change in the frequency as indicated at 32, and the peak of the change in amplitude as indicated at 33. In the case of sensor 12, it is possible that both the frequency and the amplitude change, as the coin moves past, in a first direction to a first peak, and in a second direction to a negative peak (or trough) and again in the first direction, before returning to the idle value. Processor 18 is therefore arranged to record the value of the first frequency and amplitude peaks at 32' and 33' respectively, and the second (negative) frequency and amplitude peaks at 32" and 33" respectively.

At stage III, all the values recorded at stage II are applied to various algorithms at blocks 34. Each algorithm takes a peak value and the corresponding idle value to produce a normalised value, which is substantially independent of temperature variations. For example, the algorithm may be arranged to determine the ratio of the change in the parameter (amplitude or frequency) to the idle value. Additionally, or alternatively, at this stage III the processor 18 may be arranged to use calibration data which is derived during an initial calibration of the validator and which indicates the extent to which the sensor outputs of the validator depart from a predetermined or average validator. This calibration data can be used to compensate for validator-to-validator variations in the sensors.

At stage IV, the processor 18 stores the eight normalised sensor outputs as indicated at blocks 36. These are used by the processor 18 during the processing stage V which determines whether the measurements represent a genuine coin, and if so the denomination of that coin. The normalised outputs are represented as $S_{ijk}$ where:

i represents the sensor (1=sensor 10, 2=sensor 12 and 3=sensor 14), j represents the measured characteristic (f=frequency, a=amplitude) and k indicates which peak is represented (1=first peak, 2=second (negative) peak).

It is to be noted that although FIG. 2 sets out how the sensor outputs are obtained and processed, it does not indicate the sequence in which these operations are performed. In particular, it should be noted that some of the normalised sensor values obtained at stage IV will be derived before other normalised sensor values, and possibly even before the coin reaches some of the sensors. For example the normalised sensor values $S_{1f1}$, $S_{1a1}$ derived from the outputs of sensor 10 will be available before the normalised outputs $S_{2f1}$, $S_{2a1}$ derived from sensor 12, and possibly before the coin has reached sensor 12.

Referring to section V of FIG. 2, blocks 38 represent the comparison of the normalised sensor outputs with predetermined ranges associated with respective target denominations. This procedure of individually checking sensor outputs against respective ranges is conventional.

Block 40 indicates that the two normalised outputs of sensor 10, $S_{1f1}$ and $S_{1a1}$, are used to derive a value for each of the target denominations, each value indicating how close the sensor outputs are to the mean of a population of that target class. The value is derived by performing part of a Mahalanobis distance calculation.

In block 42, another two-parameter partial Mahalanobis calculation is performed, based on two of the normalised sensor outputs of the sensor 12, $S_{2f1}$, $S_{2a1}$ (representing the frequency and amplitude shift of the first peak in the sensor output).

At block 44, the normalised outputs used in the two partial Mahalanobis calculations performed in blocks 40 and 42 are combined with other data to determine how close the relationships between the outputs are to the expected mean of each target denomination. This further calculation takes into account expected correlations between each of the sensor outputs $S_{1f1}$, $S_{1a1}$ from sensor 10 with each of the two sensor outputs $S_{2f1}$, $S_{2a1}$ taken from sensor 12. This will be explained in further detail below.

At block 46, potentially all normalised sensor output values can be weighted and combined to give a single value which can be checked against respective thresholds for different target denominations. The weighting co-efficients, some of which may be zero, will be different for different target denominations.

The operation of the validator will now be described with reference to FIG. 3.

This procedure will employ an inverse co-variance matrix which represents the distribution of a population of coins of a target denomination, in terms of four parameters represented by the two measurements from the sensor 10 and the first two measurements from the sensor 12.

Thus, for each target denomination there is stored the data for forming an inverse co-variance matrix of the form:

| | | | | |
|---|---|---|---|---|
| M = | mat1,1 | mat1,2 | mat1,3 | mat1,4 |
| | mat2,1 | mat2,2 | mat2,3 | mat2,4 |
| | mat3,1 | mat3,2 | mat3,3 | mat3,4 |
| | mat4,1 | mat4,2 | mat4,3 | mat4,4 |

This is a symmetric matrix where mat x,y=mat y,x, etc. Accordingly, it is only necessary to store the following data:

| | | | |
|---|---|---|---|
| mat1,1 | mat1,2 | mat1,3 | mat1,4 |
| | mat2,2 | mat2,3 | mat2,4 |
| | | mat3,3 | mat3,4 |
| | | | mat4,4 |

For each target denomination there is also stored, for each property m to be measured, a mean value $x_m$.

The procedure illustrated in FIG. 3 starts at step 300, when a coin is determined to have arrived at the testing section. The program proceeds to step 302, whereupon it waits until the normalised sensor outputs $S_{1f1}$ and $S_{1a1}$ from the sensor 10 are available. Then, at step 304, a first set of calculations is performed. The operation at step 304 commences before any normalised sensor outputs are available from sensor 12.

At step 304, in order to calculate a first set of values, for each target class the following partial Mahalanobis calculation is performed:

$$D1=mat1,1\cdot\partial1\cdot\partial1+mat2,2\cdot\partial2\cdot\partial2+2\cdot(mat1,2\cdot\partial1\cdot\partial2)$$

where $\partial1=S_{1f1}-x_1$ and $\partial2=S_{1a1}-x_2$, and $x_1$ and $x_2$ are the stored means for the measurements $S_{1f1}$, and $S_{1a1}$ for that target class.

The resulting value is compared with a threshold for each target denomination. If the value exceeds the threshold, then at step 306 that target denomination is disregarded for the rest of the processing operations shown in FIG. 3.

It will be noted that this partial Mahalanobis distance calculation uses only the four terms in the top left section of the inverse co-variance matrix M.

Following step 306, the program checks at step 308 to determine whether there are any remaining target classes following elimination at step 306. If not, the coin is rejected at step 310.

Otherwise, the program proceeds to step 312, to wait for the first two normalised outputs S2*f*, and S2*a*1 from the sensor 12 to be available.

Then, at step 314, the program performs, for each remaining target denomination, a second partial Mahalanobis distance calculation as follows:

$$D2=mat3,3\cdot\partial3\cdot\partial3+mat4,4\cdot\partial4\cdot\partial4+2\cdot(mat3,4\cdot\partial3\cdot\partial4)$$

where $\partial3=S_{2f1}-x_3$ and $\partial4=S_{2a1}-x_4$, and $x_3$ and $x_4$ are the stored means for the measurements $S_{2f1}$ and $S_{2a1}$ for that target class.

This calculation therefore uses the four parameters in the bottom right of the inverse co-variance matrix M.

Then, at step 316, the calculated values D2 are compared with respective thresholds for each of the target denominations and if the threshold is exceeded that target denomination is eliminated. Instead of comparing D2 to the threshold, the program may instead compare (D1+D2) with appropriate thresholds.

Assuming that there are still some remaining target denominations, as checked at step 318, the program proceeds to step 320. Here, the program performs a further calculation using the elements of the inverse co-variance matrix M which have not yet been used, i.e. the cross-terms principally representing expected correlations between each of the two outputs from sensor 10 with each of the two outputs from sensor 12. The further calculation derives a value DX for each remaining target denomination as follows:

$$DX=2\cdot(mat1,3\cdot\partial1\cdot\partial3+mat1,4\cdot\partial1\cdot\partial4+mat2,3\cdot\partial2\cdot\partial3+mat2,4\cdot\partial2\cdot\partial4\ )$$

Then, at step 322, the program compares a value dependent on DX with respective thresholds for each remaining target denomination and eliminates that target denomination if the threshold is exceeded. The value used for comparison may be DX (in which case it could be positive or negative). Preferably however the value is D1+D2+DX. The latter sum represents a full four-parameter Mahalanobis distance taking into account all cross-correlations between the four parameters being measured.

At step 326 the program determines whether there are any remaining target denominations, and if so proceeds to step 328. Here, for each target denomination, the program calculates a value DP as follows:

$$DP=\sum_{n=1}^{8}\partial_n\cdot a_n$$

where $\partial_1 \ldots \partial_8$ represent the eight normalised measurements $S_{i,j,k}$ and $a_1 \ldots a_8$ are stored coefficients for the target denomination. The values DP are then at step 330 compared with respective ranges for each remaining target class and any remaining target classes are eliminated depending upon whether or not the value falls within the respective range. At step 334, it is determined whether there is only one remaining target denomination. If so, the coin is accepted at step 336. The accept gate is opened and various routing gates are controlled in order to direct the coin to an appropriate destination. Otherwise, the program proceeds to step 310 to reject the coin. The step 310 is also reached if all target denominations are found to have been eliminated at step 308, 318 or 326.

The procedure explained above does not take into account the comparison of the individual normalised measurements with respective window ranges at blocks 38 in FIG. 2. The procedure shown in FIG. 3 can be modified to include these steps at any appropriate time, in order to eliminate further the number of target denominations considered in the succeeding stages. There could be several such stages at different points within the program illustrated in FIG. 3, each for checking different measurements. Alternatively, the individual comparisons could be used as a final boundary check to make sure that the measurements of a coin about to be accepted fall within expected ranges. As a further alternative, these individual comparisons could be omitted.

In a modified embodiment, at step 314 the program selectively uses either the measurements $S_{2f1}$ and $S_{2a1}$ (representing the first peak from the second sensor) or the measurements $S_{2f2}$ and $S_{2a2}$ (representing the second peak from the second sensor), depending upon the target class.

There are a number of advantages to performing the Mahalanobis distance calculations in the manner set out above. It will be noted that the number of calculations performed at stages 304, 314 and 320 progressively decreases as the number of target denominations is reduced. Therefore, the overall number of calculations performed as compared with a system in which a full four-parameter Mahalanobis distance calculation is carried out for all target denominations is substantially reduced, without affecting discrimination performance. Furthermore, the first calculation at step 304 can be commenced before all the relevant measurements have been made.

The sequence can however be varied in different ways. For example, steps 314 and 320 could be interchanged, so that the cross-terms are considered before the partial Mahalanobis distance calculations for measurements $\partial3$ ($=S_{2f1}-x_3$) and $\partial4$ ($=S_{2a1}-x_4$) are performed. However, the sequence described with reference to FIG. 3 is preferred because the calculated values for measurements $\partial3$ and $\partial4$ are likely to eliminate more target classes than the cross-terms.

In the arrangement described above, all the target classes relate to articles which the validator is intended to accept. It would be possible additionally to have target classes which relate to known types of counterfeit articles. In this case, the procedure described above would be modified such that, at step 334, the processor 18 would determine (a) whether there is only one remaining target class, and if so (b) whether this target class relates to an acceptable denomination. The program would proceed to step 336 to accept the coin only if both of these tests are passed; otherwise, the coin will be rejected at step 310.

Following the acceptance procedure described with reference to FIG. 3, the processor 18 carries out a verification procedure which is set out in FIG. 4.

The verification procedure starts at step 338, and it will be noted that this is reached from both the rejection step 310 and the acceptance step 336, i.e. the verification procedure is applied to both rejected and accepted currency articles. At step 338, an initialisation procedure is carried out to set a pointer TC to refer to the first one of the set of target classes for which acceptance data is stored in the validator.

At step 340, the processor 18 selects five of the normalised measurements $S_{i,j,k}$. In order to perform this selection, the validator stores, for each target class, a table containing five entries, each entry storing the indexes i, j, k of the respective one of the measurements to be selected. Then, the processor 18 derives P, which is a 1×5 matrix [p1,p2,p3,p4, p5] each element of which represents the difference between a selected normalised measurement $S_{i,j,k}$ of a property and a stored average $x_m$ of that property of the current target class.

The processor 18 also derives $P^T$ which is the transpose of P, and retrieves from a memory values representing M', which is a 5×5 symmetric inverse covariance matrix representing the correlation between the 5 different selected measurements P in a population of coins of the current target class:

| | | | | | |
|---|---|---|---|---|---|
| M' = | mat'1,1 | mat'1,2 | mat'1,3 | mat'1,4 | mat'1,5 |
| | mat'2,1 | mat'2,2 | mat'2,3 | mat'2,4 | mat'2,5 |
| | mat'3,1 | mat'3,2 | mat'3,3 | mat'3,4 | mat'3,5 |
| | mat'4,1 | mat'4,2 | mat'4,3 | mat'4,4 | mat'4,5 |
| | mat'5,1 | mat'5,2 | mat'5,3 | mat'5,4 | mat'5,5 |

As with the matrix M, matrix M' is symmetric, and therefore it is not necessary to store separately every individual element.

Also, at step 340, the processor 18 calculates a Mahalanobis distance DC such that:

$$DC=P\cdot M'\cdot P^T$$

The calculated five-parameter Mahalanobis distance DC is compared at step 342 with a stored threshold for the current target class. If the distance DC is less than the threshold then the program proceeds to step 344.

Otherwise, it is assumed that the article does not belong to the current target class and the program proceeds to step 346. Here, the processor checks to see whether all the target classes have been checked, and if not proceeds to step 348. Here, the pointer is indexed so as to indicate the next target class, and the program loops back to step 340.

In this way, the processor 18 successively checks each of the target classes. If none of the target classes produces a Mahalanobis distance DC which is less than the respective threshold, then after all target classes have been checked as determined at step 346, the processor proceeds to step 350, which terminates the verification procedure.

However, if for any target class it is determined at step 342 that the Mahalanobis distance DC is less than the respective threshold for that class, the program proceeds to step 344. Here, the processor 18 retrieves all the non-selected measurements $S_{i,j,k}$, together with respective ranges for these measurements, which ranges form part of the acceptance data for the respective target class.

Then, at step 352, the processor determines whether all the non-selected property measurements $S_{i,j,k}$ fall within the respective ranges. If not, the program proceeds to step 346. However, if all the property measurements fall within the ranges, the program proceeds to step 354.

Before deciding that the article belongs to the current target class, the program first checks the measurements to see if they resemble the measurements expected from a different target class. For this purpose, for each target class, there is a stored indication of the most closely similar target class (which might be a known type of counterfeit). At step 354, the program calculates a five-parameter Mahalanobis distance DC' for this similar target class. At step 356, the program calculates the ratio DC/DC'. If the ratio is high, this means that the measurements resemble articles of the current target class more than they resemble articles of the similar target class. If the ratio is low, this means that they articles may belong to the similar target class, instead of the current target class.

Accordingly, if DC/DC' exceeds a predetermined threshold, the program deems the article to belong to the current target class and proceeds to step 358; otherwise, the program proceeds to terminate at step 350.

If desired, for some target classes steps 354 and 356 may be repeated for respective different classes which closely resemble the target class. The steps 354 and 356 may be omitted for some target classes.

At step 358, the processor 18 performs a modification of the stored acceptance data associated with the current target class, and then the program ends at step 350.

The modification of the acceptance data carried out at step 358 takes into account the measurements $S_{i,j,k}$ of the accepted article. Thus, the acceptance data can be modified to take into account changes in the measurements caused by drift in the component values. This type of modification is referred to as a "self-tuning" operation.

It is envisaged that at least some of the data used in the acceptance stage described with respect to FIG. 3 will be altered. Preferably, this will include the means $x_m$, and it may also include the window ranges considered at blocks 38 in FIG. 2 and possibly also the values of the matrix M. The means $x_m$ used in the acceptance procedure of FIG. 3 are preferably the same values that are also used in the verification procedure of FIG. 4, so the adjustment may also have an effect on the verification procedure. In addition, data which is used exclusively for the verification procedure, e.g. the values of the matrix M' or the ranges considered at step 352, may also be updated.

In the embodiment described above, the data modification performed at step 358 involves only data related to the target class to which the article has been verified as belonging. It is to be noted that:

(1) The data for a different target class may alternatively or additionally be modified. For example, the target class may represent a known type of counterfeit article, in which case the data modification carried out at step 358 may involve adjusting the data relating to a target class for a genuine article which has similar properties, so as to reduce the risk of counterfeits being accepted as such a genuine article.

(2) The modifications performed at step 358 may not occur in every situation. For example, there may be some target classes for which no modifications are to be performed. Further, the arrangement may be such that data is modified only under certain circumstances, for example only after a certain number of articles have been verified as belonging to the respective target class, and/or in dependence upon the extent to which the measured properties differ from the means of the target class.

(3) The extent of the modifications made to the data is preferably determined by the measured values $S_{i,j,k}$, but instead may be a fixed amount so as to control the rate at which the data is modified.

(4) There may be a limit to the number of times (or the period in which) the modifications at step 358 are permitted, and this limit may depend upon the target class.

(5) The detection of articles which closely resemble a target class but are suspected of not belonging to the target class may disable or suspend the modifications of the target class data at step 358. For example, if the check at step 356 indicates that the article may belong to a closely-similar class, modifications may be suspended. This may occur only if a similar conclusion is reached several times by step 356 without a sufficient number of intervening occasions indicating that an article of the relevant target class has been received (indicating that attempts are being made to defraud the validator). Suspension of modifications may be accompanied by a (possibly temporary) tightening of the acceptance criteria.

It is to be noted that the measurements selected to form the elements of P will be dependent on the denomination of the accepted coin. Thus, for example, for a denomination R, it is possible that p1=∂1=$S_{1f1}$-$x_1$, whereas for a different denomination p1=∂8=$S_{3a1}$-$x_8$ (where $x_8$ is the stored mean for the measurement $S_{3a1}$). Accordingly, the processor 18 can select those measurements which are most distinctive for the denomination being confirmed.

Figure 4:
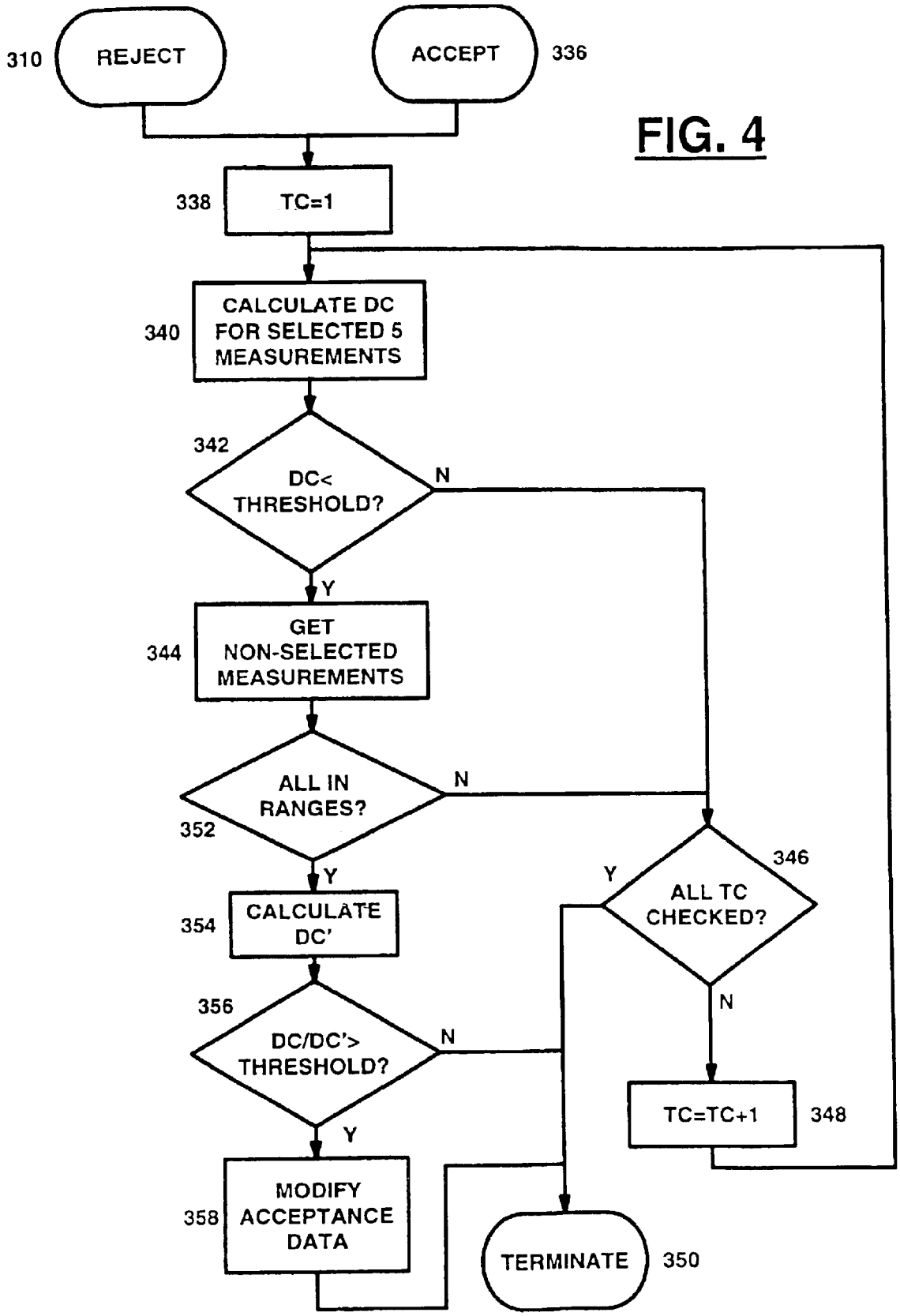
FIG. 4 is a flow chart showing an authenticity-checking operation of the validator.

Various modifications may be made to the arrangements described above, including but not limited to the following:

(a) In the verification procedure of FIG. 4, each article, whether rejected or accepted, is checked to see whether it belongs to any one of all the target classes. Alternatively, the article may be checked against only one or more selected target classes. For example, it is possible to take into account the results of the tests performed in the acceptance procedure so that in the verification procedure of FIG. 4 the article is checked only against target classes which are considered to be possible candidates on the basis of those acceptance tests. Thus, an accepted coin could be checked only against the target class to which it was deemed to belong during the acceptance procedure, and a rejected article could be tested only against the target class which it was found to most closely resemble during the acceptance procedure. It is, however, important to allow re-classification of at least some articles, especially rejected articles, having regard to the fact that the five-parameter Mahalanobis distance calculation, based on selected parameters, which is performed during the verification procedure of FIG. 4, is likely to be more reliable than the acceptance procedure of FIG. 3.

(b) If the apparatus is arranged such that articles are accepted only if they pass strict tests, then it may be unnecessary to carry out the verification procedure of FIG. 4 on accepted coins. Accordingly, it would be possible to limit the verification procedure to rejected articles. This would have the benefit that, even if genuine articles are rejected because they appear from the acceptance procedure to resemble counterfeits, they are nevertheless taken into account if they are deemed genuine during the verification procedure, so that modification of the acceptance data is not biassed.

(c) If desired the verification procedure of FIG. 4 could alternatively be used for determining whether to accept the coin. However, this would significantly increase the number of calculations required before the acceptance decision is made.

Other distance_calculations can be used instead of Mahalanobis distance calculations, such as Euclidean distance calculations.

The procedures described above can be applied to various types of acceptors, irrespective of how the acceptance data, including for example the means $x_m$ and the elements of the matrices M and M', is derived. For example, each mechanism could be calibrated by feeding a population of each of the target classes into the apparatus and reading the measurements from the sensors, in order to derive the acceptance data. However, the present invention has certain significant advantages if the acceptor is set up in the manner described below.

Preferably, the acceptance data is derived using a separate calibration apparatus of very similar construction to the acceptor, or a number of such apparatuses in which case the measurements from them can be processed statistically to derive a nominal average mechanism. Analysis of the data will then produce the appropriate acceptance data for storing in production validators.

However, due to manufacturing tolerances, the mechanisms may behave differently. The acceptance data for each mechanism could be modified in a calibration operation. In the preferred embodiment however, the sensor outputs are adjusted at blocks 34 of FIG. 2 by calibration factors determined by a calibration operation.

Figure 5:
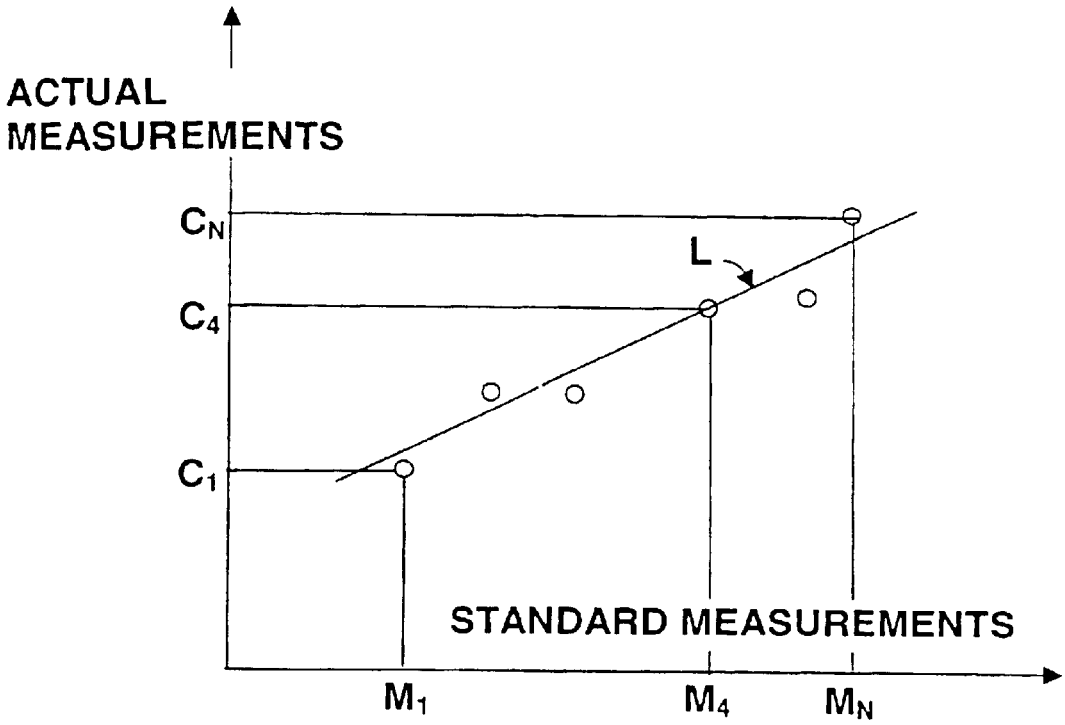
FIG. 5 is a graph to aid in explaining how calibration factors are derived.

Referring to FIG. 5, this is a graph plotting measurements of a single parameter of a number of articles of respective predetermined calibration classes, the horizontal axis representing standard measurements $M_1$ to $M_N$ and the vertical axis representing measurements $C_1$ to $C_N$ derived from the sensors of an acceptor being calibrated. The standard measurements are derived by averaging measurements made by a plurality of units of similar construction to the apparatus under test, and are recorded for use in calibrating other acceptors.

After the measurements $C_1$ to $C_N$ have been derived, a regression function is used to derive the closest linear relationship (represented in FIG. 5 by the line L) between the measurements $C_1$ to $C_N$ from the acceptor being calibrated and the standard measurements $M_1$ to $M_N$. For example, the gain (i.e. the inverse of the slope) of the line can be derived from:

$$G = \frac{N\sum_1^N M_n^2 - \left(\sum_1^N M_n\right)^2}{N\sum_1^N C_n M_n - \sum_1^N M_n \sum_1^N C_n}$$

where N=the number of calibration classes.

The intercept or offset is given by:

$$O = \frac{\sum_1^N M_n - G\left(\sum_1^N C_n\right)}{N}$$

For each measurement type, the gain G and offset O factors are stored within the validator, and are used at blocks 34 of FIG. 2. It is preferred that, instead of using raw data from each of the sensors in the standard units and in the acceptor being calibrated, normalised values are used. For example, each sensor measurement may be derived from the raw digital data R representing the article measurement (which may be a peak value of amplitude or frequency if a coin is passing a coil) and a digital idle value I which represents the raw sensor reading when no article is present. The measurement A may be for example:

$$A=(R-I)/I$$

Accordingly, each block 34 preferably first normalises each of the sensor measurements, and then applies the gain and offset values to transform the initial digital measurement A into a value M using the formula:

$$M=A\cdot G+O$$

The initial acceptance criteria could be refined in a preliminary operation by using the self-tuning feature, involving the data modification at step 358 of FIG. 4. This is preferably carried out under the control of an operator using known articles, the operation forming part of the calibration procedure and preferably being designed to result in significantly tighter acceptance criteria before the validator is left for use in the field.

Figure 6:
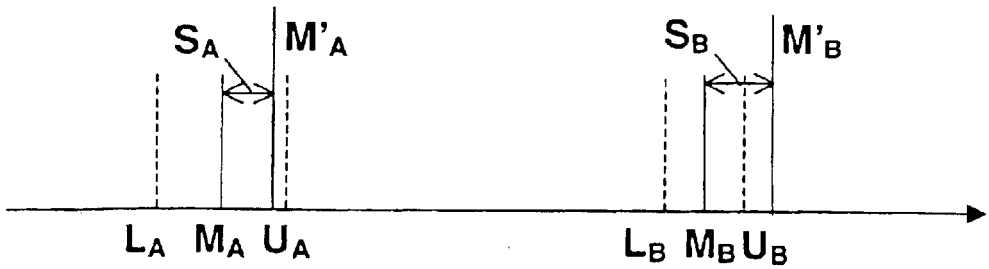
FIG. 6 is a diagram illustrating the effects of self-tuning on stored mean values.

Referring to FIG. 6, $M_A$ represents a stored mean for one measurement of a currency article of class A. This is stored in the validator after the calibration stage and is used during initial operation of the validator to determine whether a measured article belongs to class A. For example, the mean may be used in one of the blocks 38 of FIG. 2 for checking that a measurement lies between upper and lower limits ($U_A$ and $L_A$, respectively in FIG. 6) centred on the mean. The mean value may also be used in the Mahalanobis distance calculations of steps 304 and 314 of FIG. 3. The mean may additionally be used in the verification procedure of FIG. 4, in step 340 and/or step 354, again for calculating Mahalanobis distances. Similar values are also shown for an article of class B, at $M_B$, $U_B$ and $L_B$.

At a later stage, as a result of the modification of the acceptance data at step 358 in FIG. 4, the mean values may shift to the levels shown at $M'_A$ and $M'_B$ in FIG. 6.

The original values $M_A$ and $M_B$ are stored, either within the currency acceptor or separately, possibly in a central location, and are used when re-configuring the acceptor so that it can recognise articles of a different class.

The principle of one possible re-configuration operation will be described with reference to the graph of FIG. 7, in which the horizontal axis represents the original mean values (e.g. $M_A$ and $M_B$) of the different classes, and the vertical axis represents the changes in these values (e.g. $M'_A-M_A$ and $M'_B-M_B$) resulting from the self-tuning modification of the acceptance data performed at step 358 in FIG. 4.

In a simple embodiment, it is assumed that the variations between changes in the means for different classes, with respect to their original values, is linear, at least over a small range of sensor output values.

Assuming that the acceptor is to be re-configured to accept a denomination X, then an initial mean value $M_X$ is provided. This can be determined in the same way that the other mean values $M_A$, $M_B$, etc. are derived, for example involving testing articles in a central location to derive measurements applicable to a standard (possibly nominal) validator.

Figure 7:
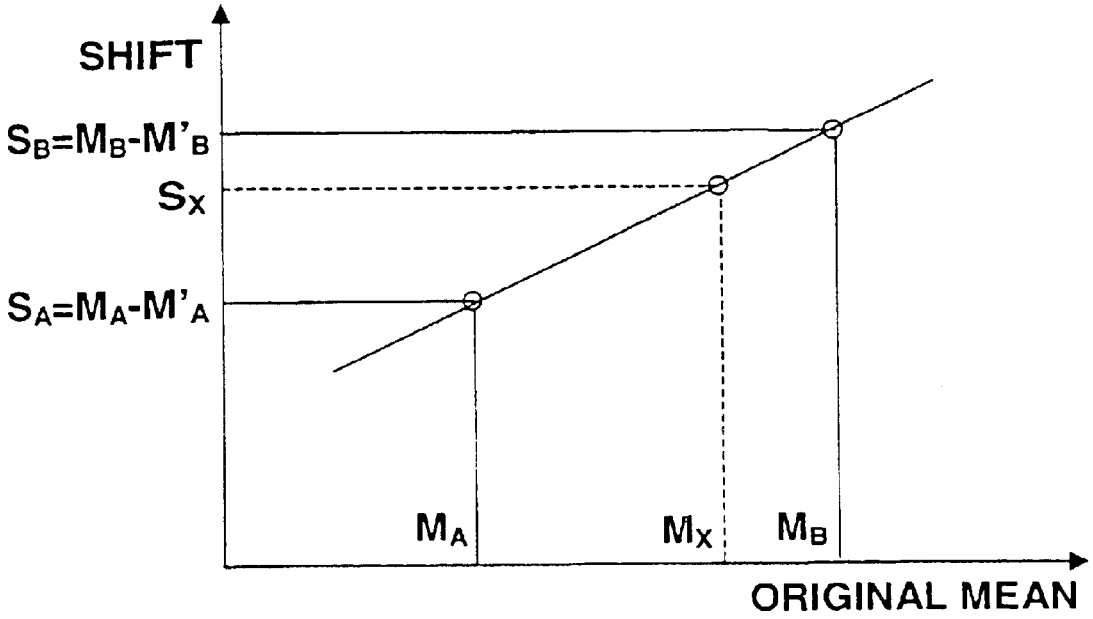
FIG. 7 is a graph to illustrate one method for calculating modifications of the acceptance criteria for a new denomination.

Given the initial mean values for classes A, B and X, and the shifts in the mean values for classes A and B, and assuming that the variation in the shifts is linear, it will be appreciated from FIG. 7 that a shift value for the class X can be determined easily using standard mathematical techniques, whereby:

$$S_X=S_A+(S_B-S_A)(M_X-M_A)/(M_B-M_A)$$

where $S_N$ represents the difference between the original mean $M_N$ and the current, shifted mean $M'_N$.

Accordingly, the mean value for denomination X can be modified according to this calculated shift before it is used for recognition of articles of this denomination, so the new mean $M'_X=M_X+S_X$.

Figure 8:
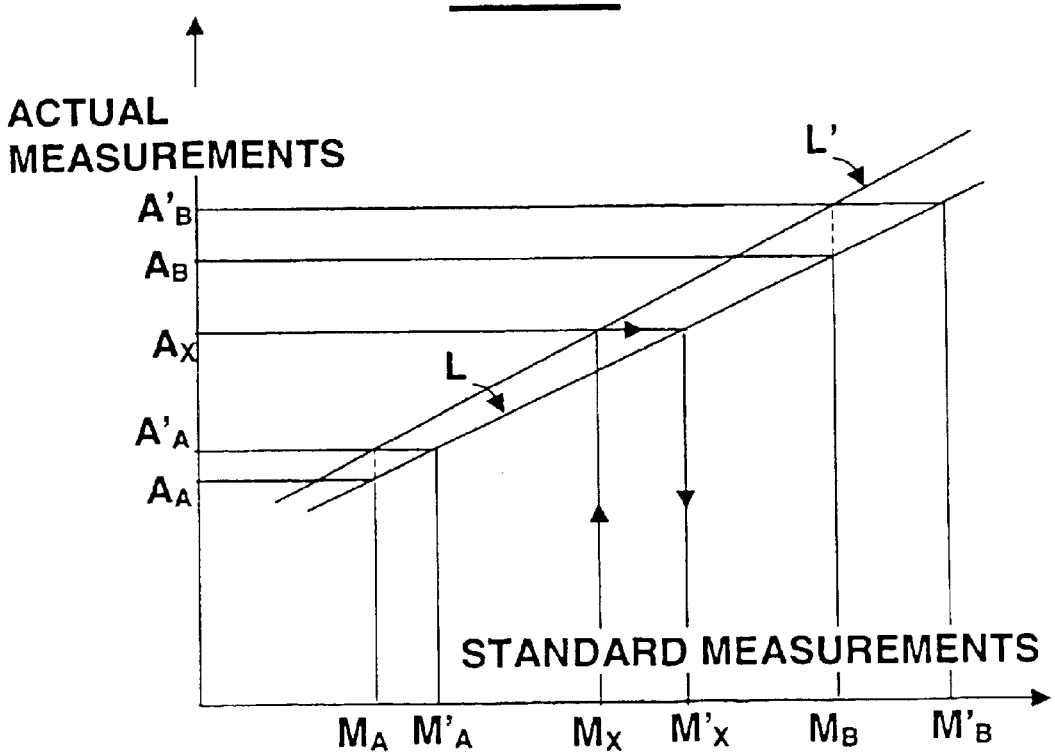
FIG. 8 is a graph to illustrate an alternative method for calculating modifications of the acceptance criteria for a new denomination.

A second, alternative technique for re-configuring the acceptor will be described with reference to the graph of FIG. 8. The horizontal axis represents the standard measurements ($M_A$ and $M_B$) for the different classes, and the vertical axis represents the actual (normalised) sensor measurements ($A_A$ and $A_B$) of the unit being re-calibrated. Accordingly, the line L represents the original relationship between these values as defined by the calibration factors G and O.

The shifted values are shown at $M'_A$ and $M'_B$. It is possible to derive from these values, and the line L, the corresponding actual sensor values $A'_A$ and $A'_B$ which correspond to the shifted mean values. The shifted sensor values $A'_A$ and $A'_B$, together with the original standard values $M_A$ and $M_B$, can be used to define a modified calibration factor represented by the line L'. This would represent the correct calibration of the acceptor, taking into account self-tuning shifts. However, it is noted that in the present embodiment the originally-stored calibration factors G, O are not changed.

A standard value $M_X$ for the new class is derived in the normal way using standard acceptor units. It is then possible to determine the corresponding actual sensor value $A_X$ using the corrected calibration line L'. This represents the expected sensor readings when measuring an article of the new denomination. The corrected mean value $M'_X$ is then derived from the actual value $A_X$ and the original calibration line L (represented by factors G, O), because this represents the transform which will be used by the acceptor.

Figure 9:
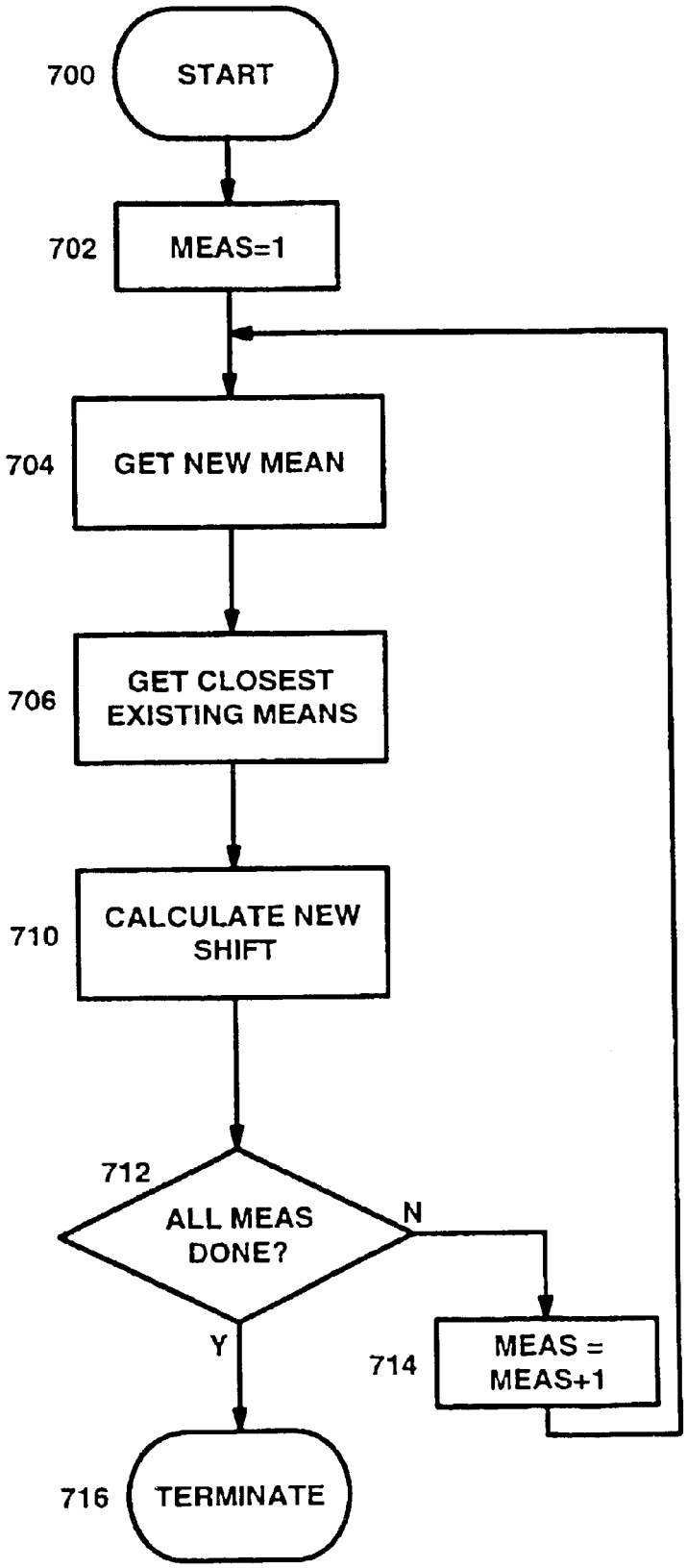
FIG. 9 is a flowchart of a re-configuration operation.

The steps involved in the re-configuration procedure are shown in the flowchart of FIG. 9. The program starts at step 700. At step 702 a pointer MEAS is set to represent the first of the sensor measurement types.

At step 704, the program derives the initial mean value ($M_X$) for this measurement, for the new denomination X.

At step 706, the program finds the closest two original mean values ($M_A$ and $M_B$) for this parameter MEAS which lie respectively above and below the mean $X_M$ for the new denomination. If this is not possible, the program finds the two closest original mean values which both lie above (or below) the new mean value $X_M$.

At step 710, the program then calculates a new mean value $M'_X$ using either of the procedures described with reference to FIGS. 7 and 8.

At step 712, the program determines whether all measurement types have been processed. If not, the program proceeds to step 714, to increment the pointer MEAS, and then repeats steps 704, 706 and 710 for the next measurement type. When all measurement types have been processed, the re-configuration program stops at step 716.

Subsequent operation of the validator will result in self-tuning operations which change the mean value $M'_X$.

Many modifications of this procedure are possible. For example, it is not essential to take two shift values and assume a linear relationship. It may be sufficient to use only a single shift value for predicting an appropriate mean for a new class. Alternatively, multiple shift values can be taken, and then a linear (or non-linear) approximation can be derived to determine the relationship therebetween. Although the described technique has been applied to calculating mean values, it could instead be used for calculating shifts in upper and/or lower limits.

In the arrangement described above, articles are recognised using acceptance criteria which are modified in accordance with a self-tuning operation. The original acceptance criteria which were used when the apparatus was initially calibrated are also stored, either in the validator itself or elsewhere, for use in re-configuration as described above. It would be possible to use an alternative arrangement in which the validator stores separately the original acceptance criteria, together with further modification data which is altered in accordance with the self-tuning procedure. The original acceptance criteria and the modification data is then combined to form the actual acceptance criteria used by the validator when recognising articles. This, however, would require more processing to be carried out during the recognition stage than the arrangement of the preferred embodiment, in which the self-tuning operation effects modification of the acceptance criteria.

What is claimed is:

1. A method of testing a currency article, the method comprising taking multiple measurements of the article and applying acceptance criteria to digital representations of the measurements in order to determine whether the article belongs to a predetermined target class, characterised in that at least one of the digital representations is derived by processing a first digital value representative of the measurement using a plurality of calibration factors derived by a calibration operation in order to obtain a second digital value forming said digital representation.

2. A method as claimed in claim 1, where the processing operation involves the following calculation:

$$M=A\cdot G+O,$$

wherein A is the first digital value, M is the second digital value, and G and O are calibration factors.

3. A method as claimed in claim 1 or claim 2, wherein the first digital value is derived from an output of a sensor when the article is being sensed and an idle value produced by the sensor in the absence of an article.

4. A method as claimed in claim 1, including the step of modifying the acceptance criteria in response to classification of an article.

5. A method of configuring apparatus for validating currency articles, the apparatus having means for deriving a plurality of different measurements of an article and means for processing at least one of the measurements with calibration factors prior to applying acceptance criteria to the measurements in order to determine whether the article belongs to one of a number of predetermined classes, the method comprising causing the apparatus to measure each of a plurality of articles of different respective classes in order to derive a plurality of different measurements of the article, and deriving each of the calibration factors from the relationships between those measurements and corresponding standard measurements which are used also for calibration of other apparatuses.

6. A method as claimed in claim 5, wherein the calibration factors represent a linear transform of the measurements made by said apparatus such that they approximately correspond to said standard measurements.

7. A method of configuring a currency validator which is arranged to receive articles of currency and to determine whether each article belongs to one of a number of predetermined classes by taking measurements of the article and determining whether those measurements meet sets of acceptance criteria each associated with a respective class, the acceptance criteria of each set having been modified in dependence on measurements made by the validator of one or more articles which have been found to belong to the respective class; characterised in that the method comprisesrendering the apparatus capable of recognising that an article belongs to a further class by deriving a further set of acceptance criteria and modifying the criteria in accordance with the extent to which at least one other set of acceptance criteria has been modified.

8. A method as claimed in claim 7, wherein the modification of the criteria for the further class is determined by combining data representing modifications of criteria relating to at least two other classes in a predetermined manner.

9. A method as claimed in claim 7, wherein the acceptance criteria for each class includes a mean value of a measurement of articles of that class, and modification of acceptance criteria involves changing the mean value.

10. A method as claimed in claim 7, wherein the acceptance criteria for the further class is derived from (a) data values for a plurality of classes, at least one of which is said further class and at least one of which is a different class, which values are derived by testing articles of those classes in at least one separate apparatus, and (b) at least one stored data value in the apparatus used for recognising articles of said different class.

11. A method of configuring a currency validator which is capable of modifying its acceptance criteria, the method comprising enabling the validator to recognise a new class of articles by (a) deriving a nominal set of acceptance criteria for the new class, and (b) altering the acceptance criteria to an extent determined by the extent to which acceptance criteria for a further class differ from nominal acceptance criteria for that class.

12. Apparatus for re-configuring a currency validator, the apparatus being arranged to perform a method as claimed in any one of claims 5 to 11.

* * * * *